United States Patent [19]

Margittai

[11] 4,104,805

[45] * Aug. 8, 1978

[54] SEQUENTIAL DRYING SYSTEM WITH ISOLATED CLOSED DRYING PATHS

[75] Inventor: Thomas Margittai, State College, Pa.

[73] Assignee: Seymour C. Yuter, Briarcliff Manor, N.Y. ; a part interest

[ * ] Notice: The portion of the term of this patent subsequent to Jun. 12, 1990, has been disclaimed.

[21] Appl. No.: 726,166

[22] Filed: Sep. 23, 1976

Related U.S. Application Data

[60] Continuation of Ser. No. 444,456, Feb. 25, 1978, abandoned, which is a continuation of Ser. No. 284,209, Aug. 28, 1972, abandoned, which is a division of Ser. No. 65,400, Aug. 20, 1970, Pat. No. 3,738,016.

[51] Int. Cl.[2] ..... F26B 5/06; F26B 13/30

[52] U.S. Cl. ..... 34/5; 34/92

[58] Field of Search ..... 34/5, 27, 28, 29, 13, 34/34, 80, 92, 212, 213, 217, 222, 223, 228

[56] References Cited

U.S. PATENT DOCUMENTS

| | | | |
|---|---|---|---|
| 1,608,263 | 11/1926 | Fiege | 34/212 |
| 1,867,546 | 7/1932 | Baer | 34/217 |
| 2,461,770 | 2/1949 | Puccinelli | 34/212 |
| 2,474,069 | 6/1949 | Silvera | 34/223 X |
| 2,543,618 | 2/1951 | Wood | 34/212 X |
| 3,096,163 | 7/1963 | Meryman | 34/5 |
| 3,234,661 | 2/1966 | Nerge | 34/5 X |
| 3,257,738 | 6/1966 | Margittai | 34/27 |
| 3,299,525 | 1/1967 | Thuse | 34/5 |
| 3,402,479 | 9/1968 | Hohm et al. | 34/13 X |
| 3,738,016 | 6/1973 | Margittai | 34/92 |

FOREIGN PATENT DOCUMENTS

| | | | |
|---|---|---|---|
| 885,342 | 5/1943 | France | 34/223 |

*Primary Examiner*—John J. Camby
*Attorney, Agent, or Firm*—S. C. Yuter

[57] ABSTRACT

The sequential drying system comprises a plurality of drying stations each having an upper section arranged in sequence in a tunnel. Material holders which are movable are provided for holding the material to be dried. Moving means move the material holders stepwise from an upper section of one drying station to the upper section of the next drying station through the tunnel. A separate lower section is provided for each drying station for moisture collecting means. Separating means are provided for separating the upper section of the drying stations from each other in the tunnel during the drying intervals between movements of the material holders. The separating means preferably is a vertical panel mounted at one end of a material holder so that it moves with the material holder. The atmosphere in each drying station is recirculated between its upper and lower sections in a closed path. The sequential drying system is especially useful for freeze drying since different temperatures below freezing can be maintained in different drying stations.

12 Claims, 8 Drawing Figures

SEQUENTIAL DRYING SYSTEM WITH ISOLATED CLOSED DRYING PATHS

This is a continuation of application Ser. No. 444,456 filed Feb. 25, 1974, now abandoned which, in turn, was a continuation of application Ser. No. 284,209 filed Aug. 28, 1972, now abandoned. The latter application was a divisional application of a then pending application of Dr. Thomas Margittai, Ser. No. 65,400 filed Aug. 20, 1970 for a Sequential Drying System, now U.S. Pat. No. 3,738,016 issued June 12, 1973.

This invention relates to a system for sequential drying of materials having physically removable water content, and particularly foods such as fish, meat, fruit, extracts, cereals, and vegetables, as well as other materials such as pharmaceutical products, cosmetics and light chemicals. This invention is especially useful in dehydrating frozen solid material, such as meat cubes, as distinguished from dehydrating fluid materials such as fruit juices, although the invention can be used to dry fluids.

Conventional freeze-dehydrating processes are essentially based on a freeze-drying process under vacuum, which process entails the use of extensive and complex mechanical equipment with high energy input requirements and consequently high investment and operating costs. These high costs were substantially reduced by the inventions disclosed in U.S. Pat. Nos. 3,257,737 and 3,257,738, issued June 28, 1966, of Dr. Thomas Margittai, the same inventor as this invention. These earlier inventions dehydrate the material to be dried employing the technique of sublimation freeze drying with a circulating atmosphere; i.e., a technique in which frozen water as ice crystals passes to a vapor state without first liquefying, the circulating atmosphere removing the vapor and also providing the heat required for sublimation of the ice crystals. The disclosed embodiments of these earlier inventions employed a single drying chamber.

Since the drying process should be completed as fast as is practical, and since the higher the temperature the more moisture that is removed, the process should preferably be maintained at the highest practical temperature. At or near the end of the drying process the temperature can be raised above the freezing point without deterioration of the material being dried and without materially affecting the quality of the dehydrated product.

With the single chamber drying embodiment, all material must be within the chamber from the beginning to the end of the drying cycle. While the chamber is cycling through the dehydration process, the personnel and apparatus necessary for loading or unloading the drying chamber may be standing unused. Further, during the time that chamber is loaded and unloaded, the dehydration apparatus is standing idle.

As the material is dehydrated the portion nearest the drying atmosphere becomes dehydrated more quickly than the more remote material. If the process is ended when the nearer material has been dried, the more remote material may still contain moisture. If the process continues until the most remote material is dried, the process is slower than if all the material had been dried simultaneously.

The desirability for operating the new drying process at changing temperatures, the length of time necessary for the complete dehydration of the material and the lost time and money resulting from a single drying chamber, has created a need for a more efficient and flexible system for a further reduction in operating costs.

A principal object of the invention is to provide a more efficient and flexible drying system employing sublimation freeze-drying with a circulating atmosphere at reduced operating costs.

Another object of the invention is to provide an improved freeze-drying system which provides a sequence of temperatures at which the dehydration process occurs.

Another object of the invention is to provide a drying apparatus that enhances the uniform drying of all material then in the dehydration process.

Another object of the invention is to provide a freeze-drying apparatus that does not damage the material being processed.

A more general object of this invention is to provide an improved drying apparatus that substantially continuously processes the material to be dried.

Another general object of the invention is to provide such an apparatus with easy and continuous loading and unloading of the material to be dried.

Still another general object of the invention is to provide a material drying apparatus which accomplishes all of the above objects and which is economically and commercially practicable, both for freeze drying and drying above 32° F.

Briefly, in accordance with the invention, the sequential drying system comprises a plurality of sequential drying stations arranged in a tunnel. Each drying station has two sections, one to receive the material to be dried and a second containing hygroscopic means for collecting and retaining moisture. Material holding means are adapted to be moved by moving means step-wise from drying station to drying station. Separation means separate the drying stations from each other during drying intervals to form separate closed drying paths in each drying station and to substantially maintain temperature isolation between the drying stations.

A feature of the new sequential drying system is that it has the means for the temperature to be regulated over a given range and in a fixed sequence during the drying process. For example, for freeze drying vegetables it has been found that the preferable temperature at which to start the drying process is 25° F. After being processed at that temperature, the vegetables should be processed at a temperature of approximately 10° F. to 15° F. The reason for lowering the temperature is that as water is removed, the freezing point of the material being dried drops until the freezing point is at the lowest point, i.e., the eutectic point. From this point in the drying cycle the freezing point rises.

Other objects, features and advantages of the invention will be apparent from the following detailed description of the invention when read with the accompanying drawings.

DESCRIPTION OF THE PREFERRED EMBODIMENT

Figure 1:
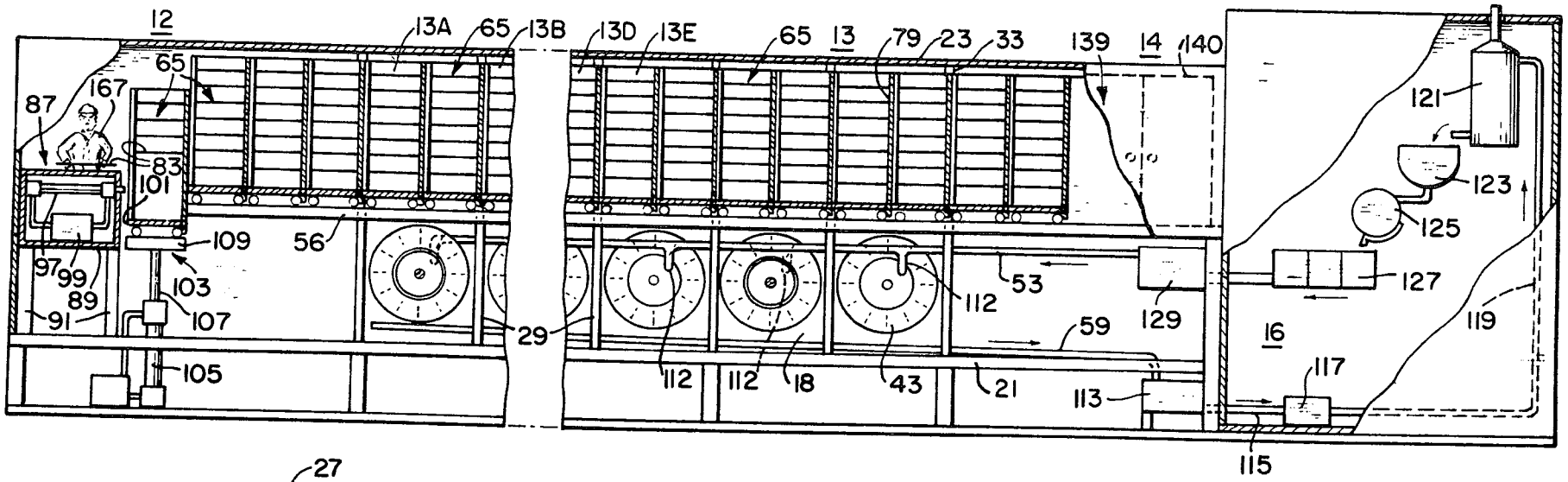
FIG. 1 is a side sectional view of the dryer constructed in accordance with the preferred embodiment of the present invention.

Referring to FIG. 1, a dryer constructed according to the present invention is illustrated. The dryer is generally referenced by numeral 11. Dryer 11 generally comprises loading area 12, drying stations 13, unloading area 14, and the reconstituting area 16. The lower section of each drying station 13 includes a moisture-extracting section 18. In brief, material to be dried is loaded in loading area 12 on trays which are stacked in tray holding means. Each tray holding means is moved step by step through drying stations 13 and the material is progressively dried. In between movements, the drying stations 13 are separated from each other and, at each drying station 13, the enclosed atmosphere is repeatedly circulated across the trays, then down to the associated moisture-extraction section 18, and then back up to and across the trays. At each moisture-extraction section 18, atmospheric moisture from the material being dried is extracted by contact with a flowable solid hygroscopic material. The solid hygroscopic material progressively liquefies and, as a liquid, is piped to the reconstituting area where it is reconstituted as a solid and returned to the moisture-extracting section 18. The tray holding means finally exits from the sequence of drying stations 13 at the unloading area 14, where the trays containing the dried material are unloaded, or are moved into a separate area and then unloaded.

In greater detail, drying stations 13 are arranged in a sequence in a tunnel. The quantity of drying stations 13 is selected according to the rate at which the material to be dried moves through drying stations 13, according to the number of different temperatures at which the material is to be held during the drying process, according to the length of the drying cycle, according to the size of the individual stations 13, etc.

While only one drying station 13 will be discussed in detail, it is to be understood that the remaining drying stations 13 are substantially similar. To indicate this similarity, drying stations 13 have been labeled each with a capital letter suffix after the reference numeral 13. The reference numeral 13C has been purposely left out to indicate that numerous other stations may be included between drying stations 13B and 13D. The drying station 13 that will be discussed in detail has been randomly picked to be the drying station 13A.

Figure 3:
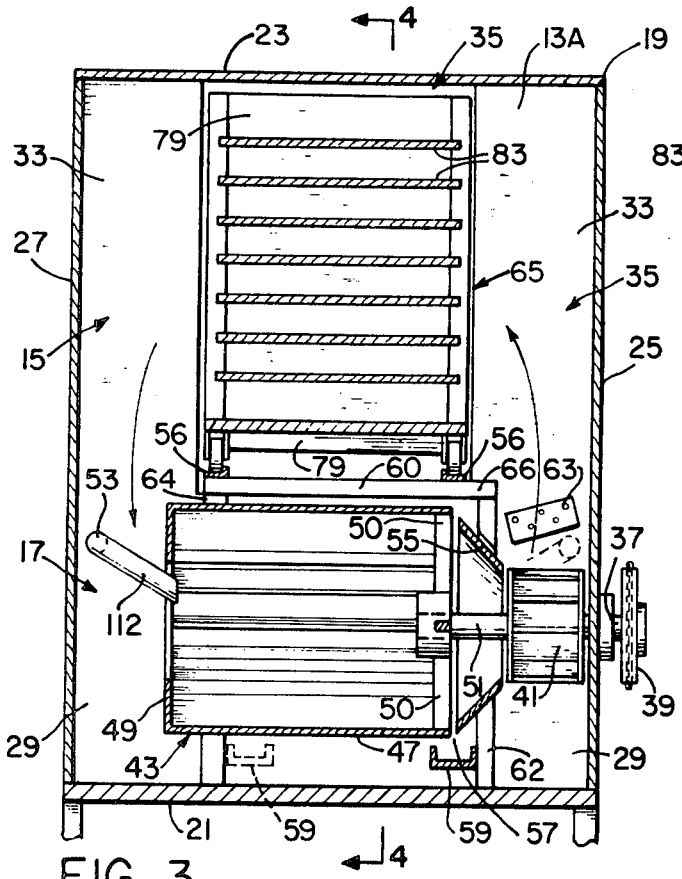
FIG. 3 is a front sectional view of the dryer of FIG. 1, along the lines 3—3 of FIGS. 2 and 4.
Figure 4:
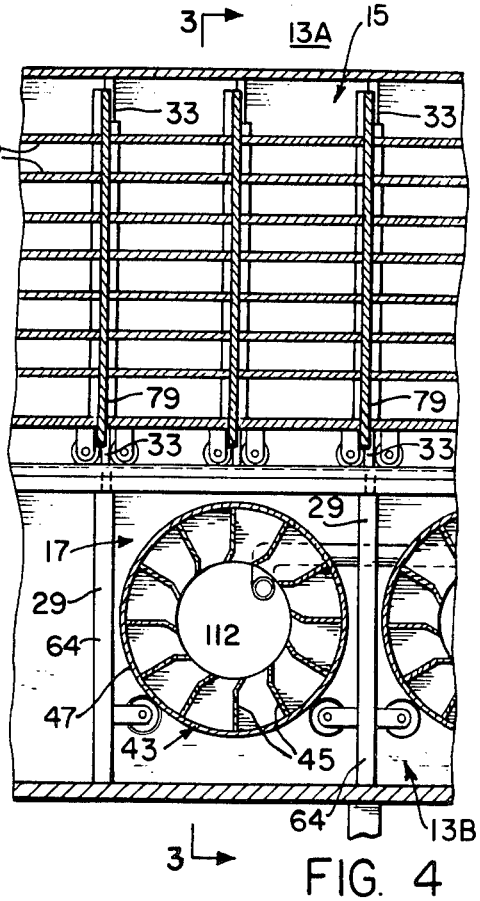
FIG. 4 is a side sectional view of the drying stations of the dryer of FIG. 1 along the lines 4—4 of FIGS. 2 and 3.

Referring to FIGS. 3 and 4, drying station 13A can be seen in greater detail. Drying station 13A comprises a first section 15 for holding the material to be dried and a second section 17 for extracting the moisture from the circulating atmosphere. In the preferred embodiment, first section 15 is above the second section 17 but they could be side by side. Note in FIG. 3 that each drying station 13 is enclosed by a continuous casing 19, composed of horizontal walls 21 and 23 and vertical walls 25 and 27, which enclose sections 15 and 17 of the drying stations 13.

Figure 2:
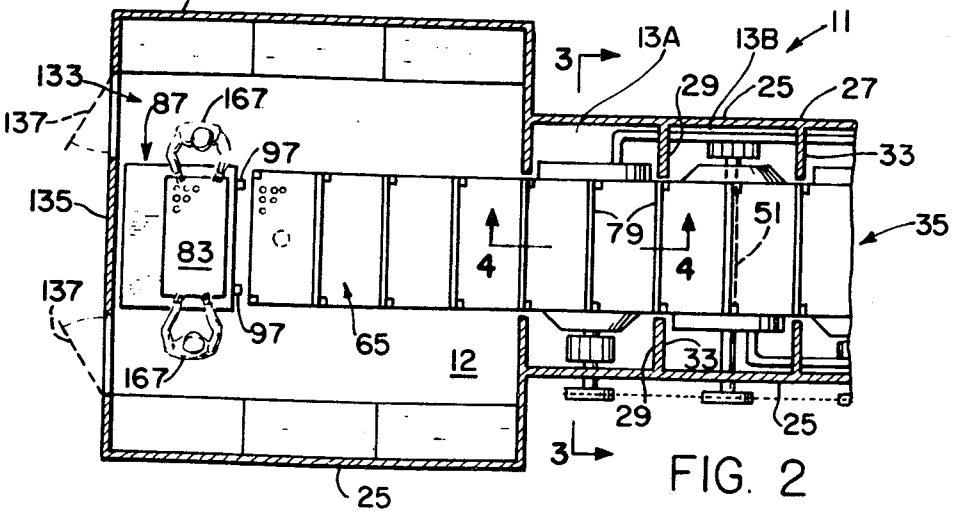
FIG. 2 is a partial sectional top view of the loading and two of the drying stations of the dryer of FIG. 1.

Separating each drying station 13 from each other are walls 29 (FIGS. 2 and 4). Walls 29 abut against horizontal wall 21 at the bottom and vertical walls 25 and 27 on the sides. Walls 29 also have vertical appendages 33, (FIGS. 2 and 4) which separate the upper sections 15 of each drying station 13 from each other. Appendages 33 (FIG. 2) abut on their sides against vertical walls 25 and 27. Appendages 33 also abut at the top against horizontal wall 23 (FIG. 1). Thus walls 29 with appendages 33 separate drying stations 13 from each other (FIGS. 1 and 2). The opening formed between walls 29 (FIG. 3), appendages 33 and horizontal wall 23 in each drying station 13 help define a tunnel 35.

Figure 6:
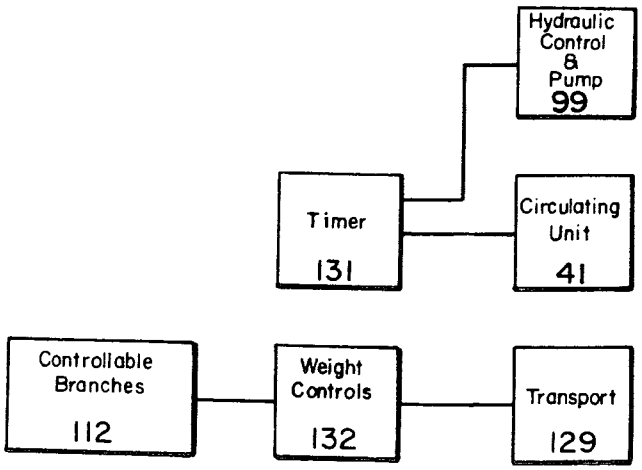
FIG. 6 is a block diagram of the central control apparatus of the illustrated dryer.

Included within each lower section 17 (FIG. 3) are the means for circulating the drying atmosphere throughout the drying stations 13, bringing that atmosphere to the predetermined temperature at which drying occurs, and removing the moisture from the drying atmosphere. These means include circulating unit 41. Circulating unit 41 can be any type of atmosphere propelling apparatus such as a fan, a blower, etc. Circulating unit 41 is connected to shaft 37 which is connected to sprocket 39. Sprocket 39 is connected by a chain (not shown) to a motor (not shown) which provides power to turn circulating unit 41. The motor is also connected to the central control apparatus (FIG. 6).

Also included in lower section 17 (FIGS. 3 and 4) is the hygroscopic holding means for holding hygroscopic material, for example, flowable solid calcium chloride. The hygroscopic holding means in the preferred embodiment comprises a drum 43 containing baffles 45. Drum 43 has a solid peripheral wall 47, an annular back wall 49 at one end, and a spider support 50 at the other end. Connected to spider support 50 is axle 51. Axle 51 is connected to shaft 37 through gear reduction means (not shown). Thus, drum 43 is driven by the motor (not shown) at a slower speed than circulating unit 41. To facilitate this, the drums 43-circulating unit 41 combination are arranged in opposite orientations in adjacent drying stations 13. For example, referring to FIG. 2, the drum 43-circulating unit 41 for drying station 13A is seen with the circulating unit located near side wall 25, while that for drying station 13B is located near side wall 27. Also note that axle 51 (shown in dotted lines) must extend through the drum 43 to reach the drum's spider 50 in drying station 13B.

Disposed between the circulating unit 41 and drum 43 is a funnel 55. Funnel 55 gathers the air or gas passing through drum 43 and directs it through circulating means 41. Funnel 55 is in a spaced relationship to drum 43. The hydroscopic material liquefies as it absorbs the moisture from the circulating atmosphere and flows out of drum 43 through the opening 57 between drum 43 and funnel 55.

Located below opening 57 is a trough 59. Trough 59 catches the liquid hygroscopic material and directs it back to the reconstituting area 16 (FIG. 1).

Also located in the lower section 17 (FIG. 3) is temperature control means 63. Temperature control means 63 maintains the particular station, in the present example station 13A, at a predetermined temperature. Temperature control means 63 can be any of those well known in the art, such as a system comprising a refrigeration coil supplied by an external compressor (not shown).

Circulating unit 41 circulates the atmosphere substantially in a plane perpendicular to the tunnel 35. Further, circulating units 41 in adjacent drying stations 13 circulate the atmosphere in opposite directions.

As will be more fully explained below, the opposite circulation of the atmosphere facilitates the uniform drying of the material and prevents damage of the material. Also, as can be seen from FIG. 3, circulating unit 41 forces the air through upper section 15 substantially perpendicular to the plane of FIG. 4. This prevents the circulating atmosphere from lifting the material to be dried at the drying tray and thereby damaging the material. The velocity of the circulating atmosphere is selected to avoid transportation of the hygroscopic material from the drum 43 to the upper section 15 in order to avoid possible contamination of the material being dried.

Located in section 15 are two rails 56 (FIGS. 1 and 3) extending substantially the full length of dryer 11. Supporting rails 56 is support means 60. Support means 60 comprises two vertical legs 62 and 64 whose lower ends abut wall 21 and whose upper ends support a cross bar 66. Rails 56 rest upon cross bar 66. Vertical legs 62 and 64 are located substantially next to wall 29. The rails 56 carry movable holding means 65. Holding means 65 hold the material to be dried.

Figure 5:
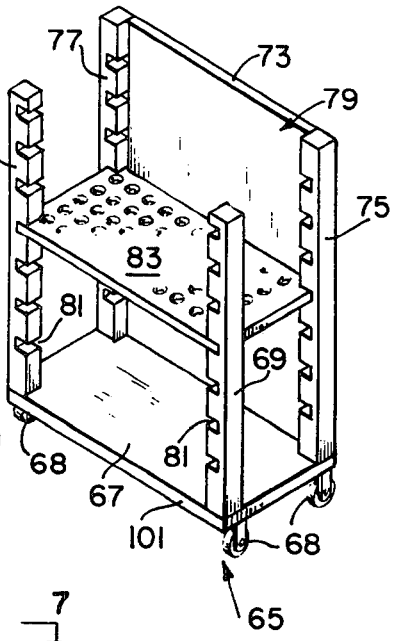
FIG. 5 is a perspective view of a holding means for the material to be dried in the dryer of FIG. 1.

Referring to FIG. 5, the preferred embodiment of the holding means 65 can be seen. Holding means 65 comprises a base 67 mounted on casters 68. The short-sided length of the base 67 is approximately equal to one-half the length of an individual drying station 13. Perpendicular to the base 67 are front upright supports 69 and 71 and rear upright supports 75 and 77. A back 73 constructed of solid material, is supported between rear upright supports 75 and 77. Back 73 together with the rear upright supports 75 and 77 comprise separating means 79. Separating means 79 extends down below base 67 as far as possible without interfering with the movability of holding means 65.

On the interior wall of supports 69, 71 and on the interior wall of supports 75 and 77 are slots 81. For a given slot 81, located a certain distance above base 67, there are located on each of the other supports a slot 81 the same distance from base 67. Thus, slots 81 are so disposed that a perforated tray 83 can be slid onto slots 81 and be horizontally supported.

Perforated tray 83 holds the material to be dried. Because of the perforations in the tray, the circulating atmosphere at the drying station is able to approach the material to be dried from above and below. Therefore, a more uniform drying of the material is achieved.

Further, because of the support arrangement involving slots 81, trays 83 are removable from holding means 65. The material to be dried can either be placed onto the trays after the trays have been inserted into holding means 65; or the material can be placed on trays 83 before the trays are inserted in holding means 65.

As related above, each holding means 65 has a separating means 79. Separating means 79 has substantially the same dimensions as the cross-section of tunnel 35 (FIG. 3). That is, the distance between the outside edges of supports 75 and 77 is slightly smaller than the distance between appendages 33, and the distance between the bottom edge and the top edge of separating means 79 is slightly smaller than the distance between the rails 56 and the inside surface of horizontal wall 23.

Referring to FIGS. 2–4, the function of the separating means 79 can be seen. Holding means 65 is moved through tunnel 35 in a stepwise fashion (described below). Between movements of holding means 65 there is a separating means 79 of a holding means 65 disposed between each station separating appendages 33. Thus, the circulating atmosphere in each station 13 is substantially prevented from traveling into the adjacent drying stations 13 by a continuous wall formed by wall 29, appendages 33, and separating means 79. This facilitates the maintenance of the atmosphere in each station 13 at a predetermined temperature by separating stations 13 from each other between stepwise movements of holding means 65.

Also included is moving means for moving holding means 65 stepwise from drying station 13 to the following drying station 13. Although many varieties of such moving means are known in the art, the apparatus chosen to be shown in the illustrated embodiment is preferred. This apparatus is chosen by way of example, and not by limitation. Those skilled in the art could easily devise other apparatus equally suitable.

The moving means has generally been designated by the reference numeral 87 (FIG. 1). Moving means 87 includes an outer casing 89 supported by legs 91 against the continuation of wall 21. Two hydraulic jacks 97 are contained within casing 89 and project therefrom. Supplying hydraulic fluid to jacks 97 is motor and control circuitry 99. As is well known in the art concerning the operation of hydraulic equipment, the piston sections of jacks 97 will extend from the jacks when fluid is pumped into the cylinders of jacks 97. These pistons of jacks 97 will bear against the back edge 101 (FIG. 5) of base 67 of holding means 65. Holding means 65 will thus be forced away from moving means 87 along rails 56 into the drying tunnel 35. The remaining holding means 65 not then being directly moved by moving means 87 are forced to move through contact with the holding means immediately in front of itself. Thus, whenever moving means 87 is activated, jacks 97 force all the holding means 65 to move a distance equal to the distance which the pistons of jacks 97 extend themselves.

The pistons of jacks 97 extend themselves so as to move each holding means 65 one-half the length of each station 13. Since each holding means 65 has a length equal to one-half the length of a station 13, two stepwise movements are necessary to move a given holding means 65 from the beginning of one drying station 13 to the beginning of the following drying station 13. Thus, each holding means 65 remains in a drying station 13 for two stepwise movements.

Also included in the preferred embodiment is loading means, generally designated by reference numeral 103 (FIG. 1). Loading means 103 comprises a hydraulic jack 105. Hydraulic jack 105 has a piston 107 supporting a table 109. Upon table 109 sits holding means 65. Referring to FIGS. 1 & 2, the operation of loading means 103 can be seen. When a holding means 65 is placed on loading means 103, piston 107 is completely extended from jack 105 placing table 109 on a level with rails 56. At this time, the operator slides into holding means 65 a tray 83. Tray 83 is then loaded with the material to be dried. This material may be stored in bins which may be fed with the material through any of the conventionally known manners such as conveyor belts, etc. As each tray 83 is placed into holding means 65 and loaded with material, piston 107 retracts into jack 105. This may be done either automatically through weight sensing of the total weight upon table 109 or manually through operator control. After the tray is completely loaded and the table 109 is near or at floor level 93, the operators may activate jack 105 so that the table 109 is returned to the level of rails 56. Alternatively, a tray 83 may be loaded before insertion into holding means 65, as illustrated in FIG. 2, and loaded from the bottom up. Moving means 87 is then activated, moving holding means 65 from table 109 onto rails 56.

Providing the atmosphere drying means in the preferred embodiment is a hygroscopic material over which the circulating atmosphere is passed. Reference should be made to the above referenced patents for detailed descriptions of the process involved. For purposes of this description, a short explanation will only be given. The hygroscopic material, for example, crystallized calcium chloride, is placed in drums 43 through branches 112 of conduit 53 (FIG. 1). Branches 112 gain access to the interior of drums 43 through the opening in the associated annular back wall 49 (FIG. 3). The hygroscopic material picks up the moisture from the atmosphere and progressively liquefies. The liquefied hygroscopic material flows out of drum 43 through openings 57 into trough 59. Trough 59 carries the material to reconstituting area 16.

Hygroscopic material regenerating means are provided for collecting the liquefied hygroscopic material, solidifying said liquefied hygroscopic material in a flowable state and returning said flowable solid hygroscopic material to the hygroscopic holding means, drums 43, in the lower sections of the drying stations 13.

The preferred embodiment provides these regenerating means through trough 59 (FIG. 3) which collects the liquefied hygroscopic material and returns it to pump 113 (FIG. 1). The liquefied hygroscopic material is pumped through conduit 115, filter 117 and conduit 119 to preheater and evaporator 121. Preheater and evaporator 121 drives off the moisture from the hygroscopic material. The resultant paste-like mass of hygroscopic agent is then passed through concentrator 123 and applied to the periphery of crystallizer 125 which removes the residual heat in the hygroscopic material and crystallizes it. The crystallized hygroscopic material, in flowable form, then passes to collecting means 127 from which it flows into transport 129. Transport 129 employs a well-known screw conveyor mechanism to transport the flowable solid crystalline hygroscopic material through conduit 53 to return it to those drums 43 which need fresh hygroscopic, material, via controllable branches 112. Each drum 43 has associated with it a weight control 132 (FIG. 6) which senses the weight of hygroscopic material in the drum 43. When the weight drops to a predetermined amount, the associated controllable branch 112 is opened and the transport 129 activated to refill the drum 43 up to a maximum predetermined amount of hygroscopic material. Alternatively, the refilling can be controlled manually using visual access ports in wall 25 to observe the amount of hygroscopic material in a drum 43. When additional hygroscopic material is needed, manual controls are employed to open a controllable branch 112 and activate the transport 129 until a sufficient amount of hygroscopic material has been supplied to the drum 43.

Timing means are also included which simultaneously cause said moving means 87 (FIG. 1) to move holding means 65 stepwise and to stop the circulating unit 41. The timing means then restarts the circulating unit 41 after the movement of the holding means 65 has ceased. By stopping the circulating means between steps, the atmospheric conditions in adjacent stations have less effect on each other.

Referring to FIG. 6, a schematic diagram of the central control apparatus can be seen. A timer 131 is connected to hydraulic control and pump 99 and circulating unit 41. Timer 131 can be any type of circuit timer well known in the art. When operated, timer 131 simultaneously causes control and pump 99 (FIG. 1) to force the pistons of jacks 97 (FIG. 2) to extend and removes the power from the motor (not shown) driving circulating unit 41 to stop the atmosphere circulation in drying stations 13. When the pistons of jacks 97 are fully extended, hydraulic control and pump 99 causes the pistons to retract. Simultaneously, the timer 131 causes circulating unit 41 to restart. The transport 129 is controlled by weight controls 132 when a controllable branch 112 is opened, as indicated above.

Figure 7:
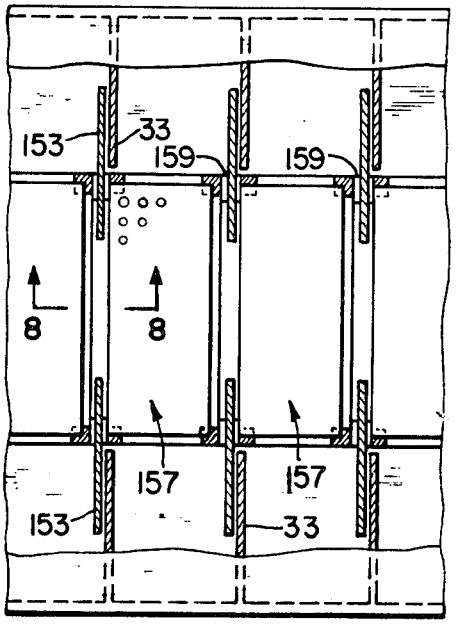
FIG. 7 is a top partial sectional view of an independent and distinct embodiment of the invention constructed in accordance with the generic concept.
Figure 8:
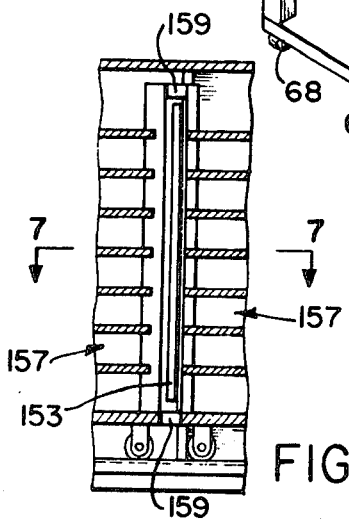
FIG. 8 is a side partial section view of the embodiment of the invention shown in FIG. 7.

The function of separating means 79 (FIG. 2) can also be performed by movable barriers which are not mounted on holding means 65. Referring to FIGS. 7 and 8, slideable panels 153 are movably mounted on appendages 33. Holding means used in this embodiment are referenced generally by the number 157. Holding means 157 are similar to holding means 65, except that in place of separating means 79 small bumpers 159 (FIGS. 7 & 8) are placed on the forward exterior side near the top and bottom of supports 75 and 77 (FIG. 5). Bumpers 159 keep adjacent holding means 157 a fixed distance apart.

During the period between movements, bumpers 159 are located in the same plane as slideable panels 153. Slideable panels 153 are moved together in between bumpers 159 (by means not shown, but much like subway car doors) until they abut, substantially separating adjacent drying stations 13. In FIG. 7, the slideable panels 153 are shown approximately one-half closed.

Referring to the loading area 12 (FIGS. 1 and 2), several additional features of the preferred embodiment can be seen. A large chamber designated by the reference numeral 133 exists between walls 25, 27 and 135. In wall 135 there is located doors 137. Doors 137 allow access to chamber 133. Contained within chamber 133 are the loading means 103 (FIG. 1) and the moving means 87, (FIG. 2). Also contained within chamber 133 are a number of loaded holding means 65. Chamber 133 may be refrigerated so that the material to be dried, if frozen, does not defrost while waiting to be loaded.

Also at the right hand portion of dryer 11 is unloading area 14 with another chamber 139. This chamber, similar to the chamber 133 contains a number of loaded holding means 65. However, the material held at this point has already been dried. The loaded holding means 65 are removed from chamber 139 through door 140. There is no problem concerning the deterioration of the material, as it has been preserved through the drying process. Therefore, the temperature of chamber 139 is preferably room temperature. The holding means 65 are unloaded and, thereafter, returned to loading area 12 for reloading.

Another feature of the dryer 11 is that the stations 13 are sized to contain two holding means 65 each. Thus, a particular holding means 65 is within the same station 13 for a duration equal to twice the time between the two movements. One skilled in the art will realize that this figure (the number of holding means 65 is each station 13) was selected as a compromise between competing variables. For example, such consideration as size of holding means 65, weight of the loaded holding means 65, the dimensions of station 13, the desirable duration of the stepwise movements, etc. are taken into account. One holding means 65 per drying station 13, or more than two, could also be provided.

OPERATION OF INVENTION

A holding means 65 is placed on table 109 (FIG. 1) of loading means 103 by operators 167. Operators 167 then place a tray 83 (FIG. 2) on the top surface of casing 89. Tray 83 is loaded with material to be dried. Tray 83 is slid in the top set of slots 81 on holding means 65. As further trays 83 are slid into holding means 65, table 109 rises, maintaining the tray 83 then being loaded at a convenient loading height. After the holding means 65 is fully loaded, table 109 has risen to the level of rails 56 under the influence of piston 107.

At the appropriate time (at the end of drying period), timer 131 (FIG. 6) removes the power from circulating unit 41 preventing the atmospheres in adjacent chambers from interfering with one another. Timer 131 then activates moving means 87 (FIGS. 1 & 2), through hydraulic control and pump 99, to push holding means 65 against the previous holding means, causing all the holding means 65 to move one step. At the appropriate times, weight controls 132 activate transport 129 to replenish the hygroscopic material in drums 43 through conduit 53.

At the end of the stepwise movement, each of the holding means 65 has moved one-half of the length of each drying station 13. Circulating units 41 are restarted by timer 131. Circulating units 41 cause the atmosphere to be passed over the material to be dried and then over the hygroscopic material. When the atmosphere is passed over the hygroscopic material, a part of its water content is removed. When passed over the material to be dried the dried atmosphere extracts the water in the material.

When drying frozen material, each drying station 13 is maintained at a predetermined temperature by temperature control means 63 (FIG. 3). As described above, this temperature is selected so as to be as high as possible consistent with maintaining the material to be dried in a frozen state. Thus, a relatively high temperature may be maintained in the first few stations 13. The temperature in the following drying stations 13 are each lower than the previous drying stations 13 until a low temperature is reached. Then the temperatures rise in each subsequent drying staion 13 until the last station which may even be close to room temperture.

Temperature isolation is substantially maintained throughout the series of drying stations 13 through which the holding means 65 passes. Each drying station 13 is separated from adjacent drying stations through walls 29 and appendages 33 (FIG. 3). Each drying station 13 has its own circulating unit 41 and drum 43.

Helping to separate adjacent drying stations 13 from one another are the separating means 79 mounted on each holding means 65. Separating means 79 are substantially the same size as tunnel 35. They separate adjacent cells from one another between the stepwise movements of holding means 65 by being positioned in the same plane as walls 29 and appendages 33 on every second holding means 65. Thus, they substantially block tunnel 35 between adjacent stations.

At chamber 139 in unloading area 14 (FIG. 1) the holding means 65 ejected from the tunnel 35 can either be stored, unloaded, or removed for unloading. The material on holding means 65 is then fully dry and need no longer be refrigerated.

The apparatus described above and in accordance with the invention continuously processes material to be dried, and provides a sequence of temperatures at which the material to be dried is processed. Further, the perforated trays 83 on which the material is laid and the fact that the atmosphere circulates in opposite directions in different drying stations 13 help insure that all the material dries at a uniform rate. Because of these provisions, there is no need to agitate the material to be dried which may cause damage to the material.

The invention also provides for convenient loading of material, including the design of the holding means 65, trays 83, and the loading means 103. Although no special unloading means are shown, one skilled in the art could easily adopt well-known manual and automated devices.

As various changes might be made in the embodiments herein disclosed, without departing from the spirit of the invention, it is understood that all matter herein shown or described should be deemed illustrative and not by way of limitation.

What is claimed is:

1. A dryer comprising a plurality of drying stations arranged in sequence;

temperature means for maintaining the temperatures in a plurality of the drying stations at preselected different temperatures below the ambient temperature;

each drying station comprising a first section for receiving the material to be dried and a second section containing hygroscoic means for collecting and retaining moisture;

holding means for holding the material to be dried;

moving means for moving said holding means stepwise from the first section of each drying station to the first section of the next drying station;

first separating means for separating the first sections of the drying stations from each other for substantially maintaining temperature isolation between said first sections during the intervals between the stepwise movements of said holding means;

second separating means for separating each second section from the other second sections for substantially maintaining temperature isolation between said second sections;

said first and second separating means associated with each drying station also being for substantially enclosing the atmosphere and forming a closed path for said drying station during the intervals between the stepwise movements of said holding means;

means for recirculating the atmosphere in the first section of each drying station in its closed path to and from the second section of said drying station during the intervals between the stepwise movements of said holding means;

each closed path of each drying station being substantially isolated from the closed path of each of the other drying stations during said intervals between the stepwise movements of said holding means.

2. The dryer of claim 1 wherein a sequence of drying stations are maintained by said temperature means at temperatures following the eutectic curve of the material being dried.

3. The dryer of claim 2 wherein said separating means are carried by said holding means.

4. A dryer as in claim 3 wherein said first section is the upper portion and said second section is the lower portion of each drying station.

5. The dryer of claim 4 including:

hygroscopic holding means in said second section adapted to hold hygroscopic material and expose it to said circulating atmosphere to absorb moisture and form liquefied hygroscopic material;

regenerating means for solidifying the liquefied hygroscopic material and returning said solid hygroscopic material to said hygroscopic holding means.

6. A freeze dryer comprising:

a plurality of drying stations connected together to form a tunnel;

temperature means for maintaining the temperature of some of said stations below the freezing point of the material being dried;

separating means for separating drying stations from each other during drying intervals;

said separating means substantially enclosing the atmosphere of each drying station during drying intervals;

circulating means associated with each of the drying stations for circulating the atmosphere in said drying station in a closed path between adjacent separating means;

said separating means also substantially maintaining temperature isolation between said closed paths.

7. The freeze dryer of claim 6 including:

moving means for moving the material to be dried from drying station to drying station;

the circulating means also being for circulating the atmosphere perpendicular to the tunnel and in opposite directions in adjacent drying stations.

8. The freeze dryer of claim 6 wherein said temperature means maintains the drying stations at predetermined temperatures in a sequence following the eutectic curve of the material being dried.

9. The freeze dryer of claim 6 including:

means before the first drying station for raising and lowering said holding means;

and perforated trays adapted to contain material to be dried removably mounted in said holding means.

10. The freeze dryer of claim 9 wherein each movable holding means is in contact with an adjacent movable holding means and all are moved simultaneously when the first movable holding means in the sequence is moved.

11. A method of freeze drying at atmospheric pressure with a plurality of drying stations connected together to form a tunnel, comprising the steps of:

(a) separating and heat insulating the drying stations from each other, and thus enclosing their atmospheres, during drying intevals;

(b) maintaining the temperatures of some of the drying stations, during drying intervals, at different preselected temperatures below the freezing point of the material to be dried; and (c) repeatedly circulating the enclosed atmosphere of each of the drying stations, first over the material to be dried to extract moisture therefrom, and then over a hygroscopic material to remove moisture in the circulating atmosphere.

12. As an article of manufacture, a freeze-dried product prepared in accordance with the process of claim 11.

* * * * *